US006471365B2

(12) United States Patent
Wang et al.

(10) Patent No.: US 6,471,365 B2
(45) Date of Patent: Oct. 29, 2002

(54) SIDEMARKER LIGHT

(75) Inventors: Shaw-Jong Wang, Hsinchu; Cheng-Chung Chen, Taoyuan, both of (TW)

(73) Assignee: Ritek Corporation (TW)

( * ) Notice: Subject to any disclaimer, the term of this patent is extended or adjusted under 35 U.S.C. 154(b) by 0 days.

(21) Appl. No.: 09/811,986

(22) Filed: Mar. 19, 2001

(65) Prior Publication Data

US 2002/0024805 A1 Feb. 28, 2002

(30) Foreign Application Priority Data

Aug. 22, 2000 (TW) ..... 89214554 U

(51) Int. Cl.[7] ..... F21V 9/16

(52) U.S. Cl. ..... 362/84; 362/216; 362/257; 362/95; 439/891; 439/694; 439/620; 439/879; 439/499

(58) Field of Search ..... 362/84, 216, 257, 362/95; 439/891, 694, 620, 879, 499

(56) References Cited

U.S. PATENT DOCUMENTS 4,144,557 A * 3/1979 Kerr, III et al. ..... 362/84
4,284,317 A * 8/1981 Doyle ..... 339/103 R
4,629,267 A * 12/1986 Stepan ..... 339/17 M
4,857,013 A * 8/1989 Peters ..... 439/484

* cited by examiner

*Primary Examiner*—Alan Cariaso
*Assistant Examiner*—Sharon Payne

(57) ABSTRACT

A sidemarker light which has a light housing, an EL slice and a fastening mechanism. The light housing has a bottom plate with at least two through holes and a top cover attached to the bottom plate. The EL slice has a lighting portion and two conductive terminals. The fastening mechanism has a pair of terminal receivers and a pair of plugs. Each terminal receiver has a terminal-buckling portion and a plug-buckling portion. The terminal-buckling portions buckle the two conductive terminals. The plug has a coupling portion that is buckled by the plug-buckling portion and a through portion that passes through the through holes on the bottom plate.

8 Claims, 3 Drawing Sheets

SIDEMARKER LIGHT

BACKGROUND OF THE INVENTION

1. Field of the Invention

The present invention relates to a sidemarker light, and particularly to a sidemarker light utilizing an electro luminescent (EL) slice as a light source.

2. Description of Related Art

Sidemarker lights have been extensively used in corridors and little rooms for leading walkers to a direction by emitting a dim light.

Existing sidemarker lights utilize a tungsten lamp as a light source. With the progress of EL slices, sidemarker lights utilizing an EL slice as a light source (EL sidemarker light) can be found in the market. Products of this kind have several advantages, such as long lifetime, little power consumption and safety. However, the structure of the known EL sidemarker lights is very complicated. For example, electrical wires must be used to solder the terminals of an EL slice and plugs, or a number of conductive rubbers and circular springs are required. Therefore, the profile and cost of the known EL sidemarker lights cannot satisfy the need of the markets.

SUMMARY OF THE INVENTION

The object of the present invention is to provide a sidemarker light utilizing an EL slice as a light source and having a simple structure.

To achieve the above object, the present invention discloses a sidemarker light, comprising a light housing, an EL slice and a fastening mechanism. The light housing includes a bottom plate having at least two through holes and a top cover coupled to the bottom plate. The EL slice includes a lighting portion and at least two conductive terminals. The fastening mechanism includes a pair of terminal receivers and a pair of plugs. The terminal receiver has a terminal-buckling portion and a plug-buckling portion. The terminal-buckling portion is used to buckle said two conductive terminals. The plug has a coupling portion for being buckled by the plug-buckling portion and a through portion for passing through the through holes on the bottom plate.

Since the EL slice and plugs are mechanically coupled together in the sidemarker light of the present invention, the components of the sidemarker light are significantly reduced, and the structure of the sidemarker light is simplified.

BRIEF DESCRIPTION OF THE DRAWINGS

The present invention is described according to the appended drawings in which.

PREFERRED EMBODIMENT OF THE PRESENT INVENTION

Figure 1:
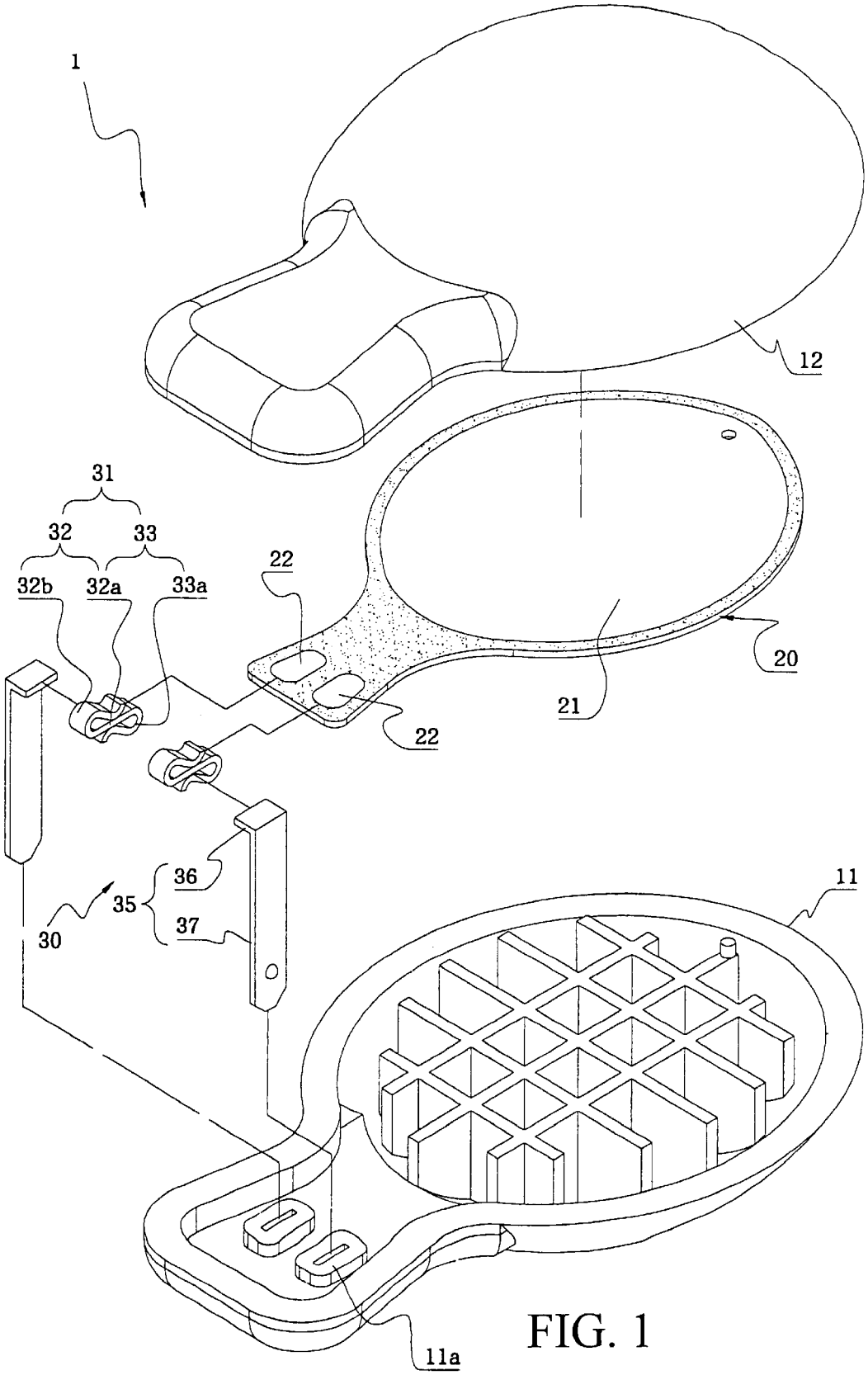
FIG. 1 shows an exploded perspective view of the sidemarker light according to the first embodiment of the present invention.
Figure 2:
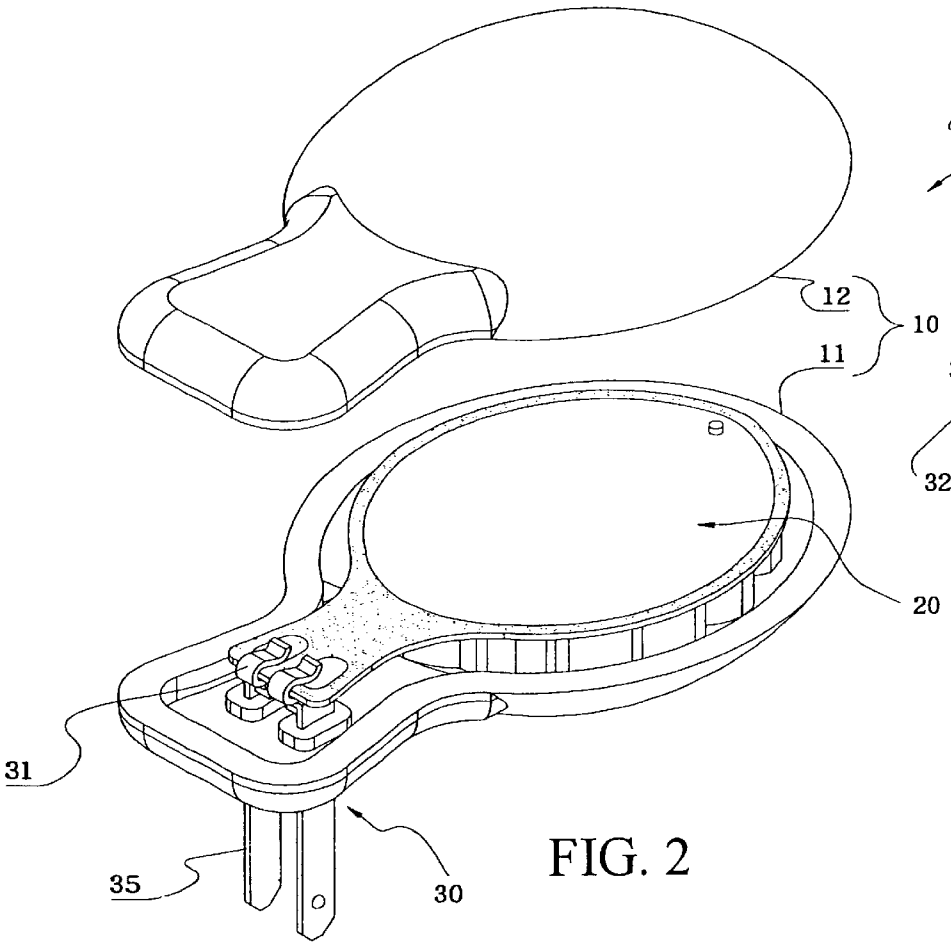
FIG. 2 shows a partial assembly view of the sidemarker light in FIG. 1.

In FIG. 1 and FIG. 2, the subject invention discloses a sidemarker light 1 comprising a light housing 10, an EL slice 20 and a fastening mechanism 30.

The light housing 10 includes a bottom plate 11 and a top cover 12 coupled to the bottom plate 11. The bottom plate 11 is provided with two through holes 11*a* for receiving plugs 35.

The EL slice 20 includes a lighting portion 21 and two conductive terminals 22. The lighting portion 21 has an electro luminescent layer (not shown) and two bias electrodes (not shown). These two bias electrodes are electrically connected to those two conductive terminals 22. Therefore, when external electricity is supplied to the two conductive terminals 22, the lighting portion 21 will luminesce.

The fastening mechanism 30 includes a pair of terminal receivers 31 and a pair of plugs 35. Each terminal receiver 31 has a terminal-buckling portion 32 and a plug-buckling portion 33. The plug 35 has a short leg and a long leg, in which the short leg serves as a coupling portion 36 and the long leg serves as a through portion 37. The cross section of the plug 35 is shaped like a letter "L." The terminal-buckling portion 32 is structured to buckle the conductive terminals 22 of the EL slice 20. The plug-buckling portion 33 is electrically and mechanically coupled to the coupling portion 36, and the through portion 37 passes through the through hole 11*a* of the bottom plate 11 and can be inserted into an indoor socket.

Furthermore, the cross section of the terminal-buckling portion 32 is shaped like a letter "R." The terminal-buckling portion 32 has a straight leg 32*a* and a first curve leg 32*b*, and an opening (not numbered) enclosed by the straight leg 32*a* and the ark first curve leg 32*b* is formed to elastically buckle the EL slice 20. The conductive terminals 22 of the EL slice 20 are electrically buckled by both legs 32*a* and 32*b*, respectively.

The end of the straight leg 32*a* extends to the direction opposite to the first curve leg 32*b* to form a second curve leg 33*a*. The cross section of an opening enclosed by the straight leg 32*a* and the second curve leg 33*a* is shaped like a letter "R," and the above configuration forms the plug-buckling portion 33 for buckling the coupling portion 36 of the plug 35. In conclusion, the cross section of the terminal receivers 31 is shaped like a double "R," and the plug-buckling portion 33 and terminal-buckling portion 32 share the straight leg 32*a*.

The coupling portion 36 of the plug 35 can be inserted into the opening enclosed by the straight leg 32a and the second curve leg 33*a* of the terminal receiver 31. The through portion 37 passes through the through hole 11*a* on the bottom plate 11 and can be inserted into an indoor socket to obtain electrical power.

Owing to the elastically buckling function of the terminal receiver 31, the EL slice 20, the light housing 10 and the fastening mechanism 30 can be successfully combined together, electrically connecting the plug 35 to the EL slice 20.

Figure 4:
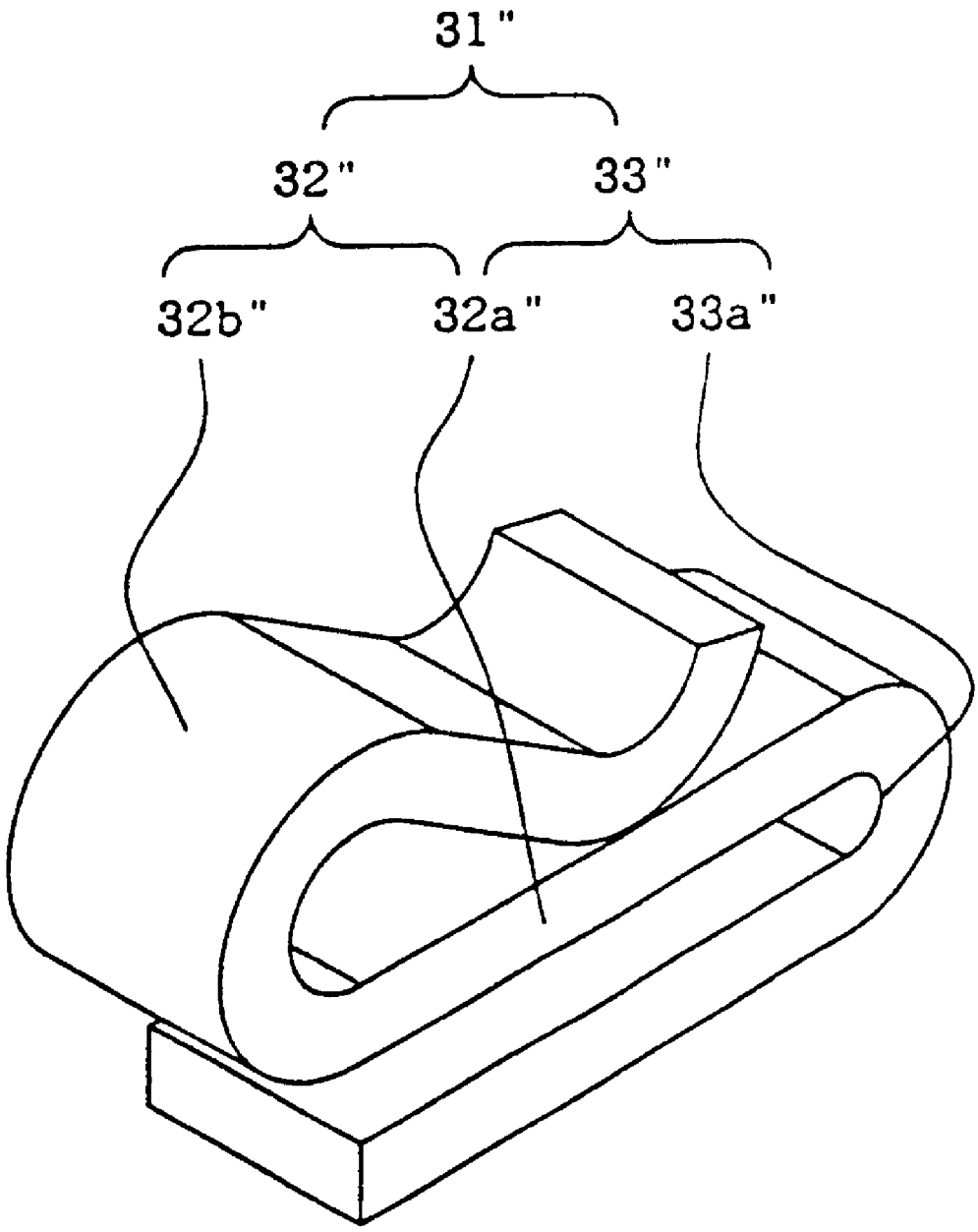
FIG. 4 shows an alternate embodiment of the plug-buckling portion.

In addition, the cross section of the opening enclosed by the straight leg 32*a*" and second curve leg 33*a*" may also be shaped like a letter "U" to completely bite the coupling portion 36 of the plug 35, as shown in FIG. 4.

Figure 3:
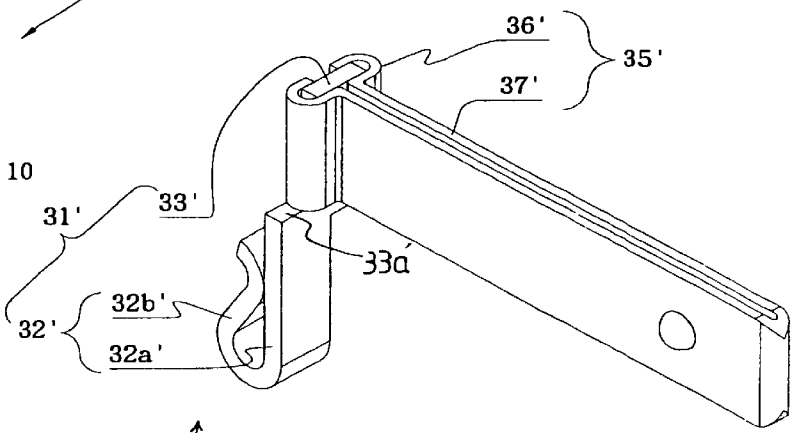
FIG. 3 shows a perspective view of a fastening mechanism according to the second embodiment of the present invention.

FIG. 3 shows another embodiment of the subject invention. A fastening mechanism 30' also comprises a pair of terminal receivers 31' and a pair of plugs 35'. Each terminal receiver 31' has a terminal-buckling portion 32' and a plug-buckling portion 33'. The plug 35' has a coupling portion 36' and a through portion 37'.

The terminal-buckling portion 32' includes a straight leg 32*a*' and a first curve leg 32*b*'. The structure of the terminal-buckling portion 32' is almost the same as the terminal-buckling portion 32 of the first embodiment and thus the description thereof is omitted. The end of the straight leg 32*a*' is extended to form a plug-buckling portion 33', and an offset portion 33*a*' is formed between the terminal-buckling portion 32' and the plug-buckling portion 33' for assembly purpose.

The plug 35' is formed by folding a rectangular conductive material to form the coupling portion 36' and the through portion 37', and each end of the conductive material is configured as a letter "U" to serve as the coupling portion 36'. The U-shaped openings of the coupling portion 36' are used to buckle the plug-buckling portion 33'. Before inserting the plugbuckling buckling portion 33' into the coupling portion 36', the folded through portion 37' is spread outwardly. After the plug-buckling portion 33' is embedded inside the U-type openings of the coupling portion 36', the conductive material of the plug 33' is pressed to form the through portion 37'.

The fastening mechanism 30 and 30' can be made of a thin copper slice to obtain the required rigidity.

The above embodiments of the present invention are provided for illustration only. Those skilled in the art may devise numerous alternative embodiments without departing from the scope of the following claims.

What is claimed is:

1. A sidemarker light, comprising:

a light housing including a bottom plate having at least two through holes and a top cover coupled to the bottom plate;

an EL slice including a lighting portion and two conductive terminals; and a fastening mechanism including a pair of terminal receivers and a pair of plugs, each said terminal receiver having a terminal-buckling portion for buckling said two conductive terminals and a plug-buckling portion; each said plug having a coupling portion for being buckled by the plug-buckling portion and a through portion for passing through the through hole on the bottom plate.

2. The sidemarker light of claim 1, wherein the terminal-buckling portion includes a straight leg and a first curve leg, and the straight leg and the first curve leg define an opening.

3. The sidemarker light of claim 1, wherein the plug-buckling portion includes a second curve leg, and the second curve leg and the straight leg of the terminal-buckling portion define an opening.

4. The sidemarker light of claim 3, wherein the plug-buckling portion is shaped like a letter "R" for buckling the coupling portion.

5. The sidemarker light of claim 3, wherein the terminal-buckling portion is shaped like a letter "R" for buckling the coupling portion.

6. The sidemarker light of claim 3, wherein the plug-buckling portion is shaped like a letter "U" for buckling the coupling portion.

7. The sidemarker light of claim 3, wherein the plug is formed by folding a rectangular conductive material to form the coupling portion and the through portion, and each end of said conductive material is configured as a letter "U" to serve as the coupling portion for buckling the plug-buckling portion.

8. The sidemarker light of claim 1, wherein the plug is shaped like a letter L, in which a short leg serves as the coupling portion and a long leg serves as the through portion.

* * * * *